United States Patent [19]

Redl et al.

[11] Patent Number: 4,622,987

[45] Date of Patent: Nov. 18, 1986

[54] ROTATABLE SHADE UMBRELLA

[75] Inventors: Stefan Redl, Midland Park, N.J.; Edmund Killian, Merrick, N.Y.

[73] Assignee: Finkel Outdoor Products, Inc., New York, N.Y.

[21] Appl. No.: 744,241

[22] Filed: Jun. 13, 1985

[51] Int. Cl.[4] ..... A45B 11/00

[52] U.S. Cl. ..... 135/20 M

[58] Field of Search ..... 135/20 M, 20 A, 20 R, 135/69, 75; 248/188.5; 403/322, 329, 332, 108

[56] References Cited

U.S. PATENT DOCUMENTS

| | | | |
|---|---|---|---|
| 2,731,973 | 1/1956 | Roth et al. | 135/20 A |
| 2,819,725 | 1/1958 | Deisenroth et al. | 135/20 M |
| 2,863,468 | 12/1958 | Small | 135/20 M |
| 3,175,568 | 3/1965 | Kafka | 135/20 M |
| 3,410,285 | 11/1968 | Small | 135/20 R |
| 4,056,115 | 11/1977 | Thomas | 403/322 |

FOREIGN PATENT DOCUMENTS

| | | | |
|---|---|---|---|
| 1062753 | 3/1967 | United Kingdom | 135/20 A |

*Primary Examiner*—James R. Feyrer

*Attorney, Agent, or Firm*—McAulay, Fields, Fisher, Goldstein & Nissen

[57] ABSTRACT

This invention provides a shade umbrella which is tiltable about a horizontal axis and which can be rotated about a vertical axis. A resiliently placed cam button protrudes through an opening adjacent each end of two annularly mated shaft portions supporting the umbrella. The button can be manually depressed to release the outer shaft, permitting removal of the umbrella or rotation for shaft control. A plurality of openings around the circumference of the outer shaft permits indexing of the shade control and the outer surface of the cam button is so shaped as to permit easy interconnection of the two shaft portions and secure locking thereof together.

6 Claims, 4 Drawing Figures

ROTATABLE SHADE UMBRELLA

This invention relates to means for providing a tiltable, easily rotatable shade umbrella, capable of tracking the sun as it moves during the day and as the seasons change.

It is well known to provide so-called garden, or shade, umbrellas with the ability to open and close, or to tilt to one side about a horizontal axis situated on and secured to the support shaft for the umbrella. Generally, however, the umbrella can be tilted in a single, or possibly two opposing directions, about a single horizontal axis; the sturdier umbrellas tilt over along a 45°-90° arc from vertical in only one direction. It is clear that especially in the warmer climes, in order to maintain the table or other surface under the umbrella in the shade during the entire day, and throughout the entire year, the umbrella must be rotatable about the axis defined by its support shaft. This can most obviously be accomplished by rotating the entire support. When the shaft is secured to the table, or anchored to another member or to the ground, the difficulty of rotation is also obvious.

An object of this invention is to provide means for easily rotating the pivotable shade umbrella. Another object is to provide such rotatable effect while providing for a secure means of anchoring the rotatable umbrella to its support shaft. Yet another object of this invention is to provide a means for quickly and securely attaching the umbrella to, or detaching it from, a support shaft, to avoid loss of the umbrella during high wind conditions, while retaining the ability to quickly remove the umbrella from the shaft. A further object of this invention is to provide a one-hand locking-unlocking operation for a positive locking mechanism to enable quick and secure attachment and quick removal. A final object is to provide means for indexing the rotation of the umbrella about preselected degrees of arc.

In accordance with this invention, there is provided a tiltable shade umbrella with means for releasably securing the umbrella to a support shaft and for providing rotational capability. The umbrella is immediately supported by an upper shaft, and optionally and preferably has the capability of being opened and closed in a known manner. The upper shaft is secured to a middle shaft, the upper shaft being capable of rotation about a horizontal axis relative to the middle shaft, the permitted degree of movement being less than about 180° of arc, and preferably less than about 90° of arc from the vertical. The middle shaft and lower shaft are in turn annularly, slidably, releasably mounted, one within the other. A cam button is resiliently secured adjacent to a first end portion of the inner umbrella shaft so as to protrude radially outside of the outer circumference of the inner shaft through an opening in the circumferential wall. Manual means are provided to permit depressing the cam button radially inwardly of the inner unbrella shaft.

The radially outer portion of the cam button comprises the cam surface. The cam surface is so designed that an annular surface sliding onwardly along the outer surface of the inner umbrella shaft, from the first end, will gradually depress and pass over the cam button surface, whereas an edge of the surface sliding offwardly along the inner umbrella shaft towards the first end, will butt up against the opposite edge of the button and be arrested.

The cam surface preferably includes a sloping portion commencing substantially at or below the outer circumference of the inner shaft at the first end-facing portion of the button, and extends in a radially outwardly direction and an axially onwardly direction along the inner shaft to a radial peak. At least a portion of the onwardly facing surface of the cam button, i.e., facing directly away from the first end, extends substantially approximately at least perpendicularly radially outwardly from the outer circumference of the inner shaft.

In a preferred embodiment, the onwardly facing surface has a radially outermost portion that slopes from the perpendicular portion radially outwardly and axially towards the first end, to the radial peak. The sideward facing portions of the cam button also are preferably defined by a surface substantially similar to the onwardly facing cam surface.

A preferred embodiment of a shade umbrella according to this invention is depicted graphically in the drawings herewith. This embodiment, although preferred, is merely exemplary of the scope of this invention and should not be taken as exclusive or limiting thereof.

Referring to the drawings.

In FIGS. 1–4 a standard shade umbrella is shown which incorporates the improvement of the present invention. The umbrella comprises the shade or umbrella portion 31 which is supported upon the upper shaft 32 extending downwardly therefrom. In this preferred embodiment, the umbrella portion 31 is foldable or collapsible, so as to surround the shaft 32 by operation of the crank and mechanism, generally indicated by the numeral 30.

Figure 1:
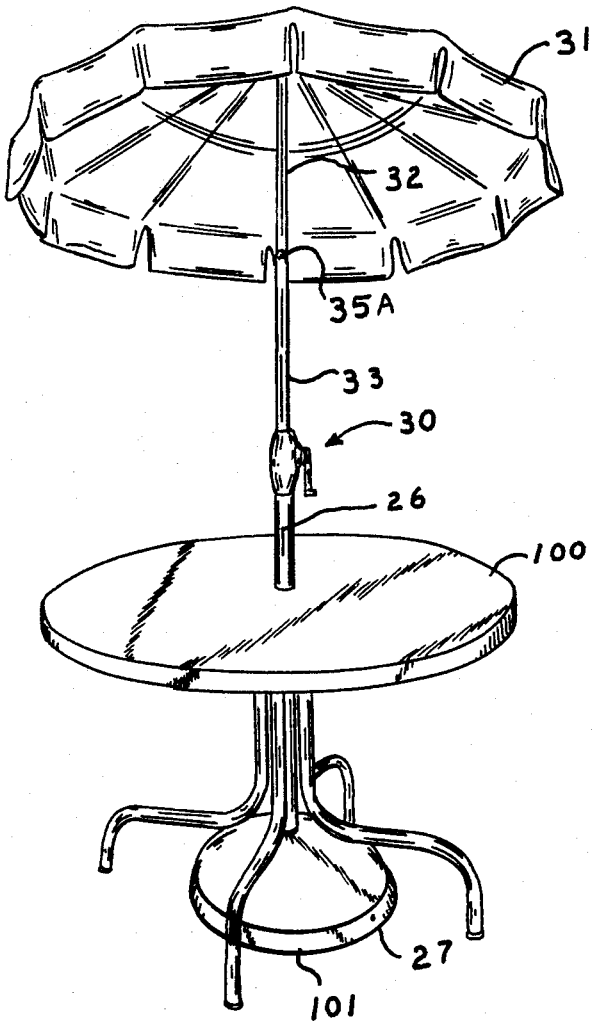
FIG. 1 is a perspective sketch of a shade umbrella of the type incorporating the mechanism of this invention.
Figure 2:
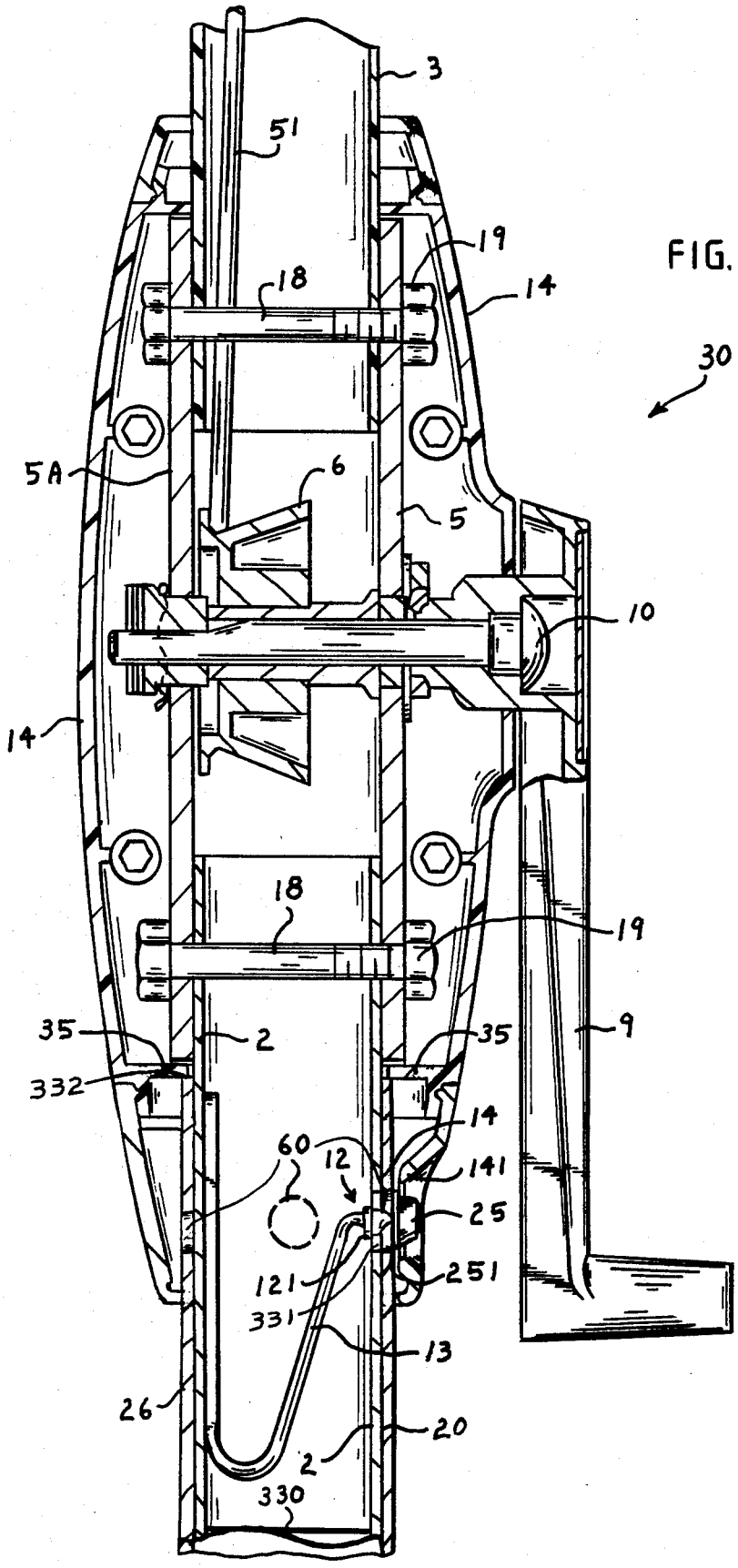
FIG. 2 is a sectional enlargement of the portion of the umbrella of FIG. 1, incorporating the present invention.
Figure 3:
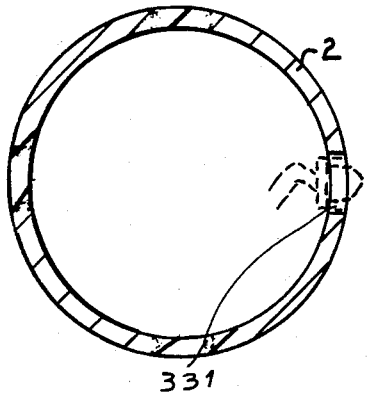
FIG. 3 is a sectional view of the inner shaft including the cam button of FIG. 1.

The upper shaft 32 is rotatably secured to the middle shaft 33 by a pin 35A. In the drawing of FIG. 1, the pin 35A extends perpendicular to the plane of the drawing such that the umbrella can be tilted by rotating the upper shaft 32 relative to the middle shaft 33 about the pin 35A. A locking mechanism of standard construction can be used to lock the umbrella in a variety of positions from the vertical position as shown, to a position wherein shaft 32 is angled as much as 90°, i.e., at about a right angle relative to the middle shaft 33. The middle shaft 33, the inner shaft, is in turn slidably held within the lower shaft 26 (the outer shaft) which passes through a central hole in the the table 100 and is anchored in metal base weigh 101.

As shown in the drawing, in this embodiment the middle shaft 33 is formed in pieces, separated by the umbrella collapsing mechanism 30: an upper middle shaft 3 and a lower middle shaft 2. The upper middle shaft 3 and the lower middle shaft 2 are rigidly secured together via the rigid side plates 5,5*a*, which are all held together rigidly by screw bolts 18 and nuts 19.

A torsion spring 13 is affixed at one end to the interior circumferential surface of the lower middle shaft 2 adjacent its lower end 330, and the second end of the torsion spring 13 has attached thereto a cam button 12. The cam button comprises a washer 121 directly secured to the free end of the torsion spring 13 and a radially outwardly extendinq cam surface 122 which in turn protrudes through a mating opening defined by circular opening 331 in the circumferential wall of lower middle shaft 2. When the lower shaft 26 is in place as the outer shaft, the cam button 12 also protrudes through one of the mating openings 60 through the outer circumferential wall of the lower shaft 26.

The casing 14 for the umbrella crank assembly 30 surrounds the middle shaft 33 including the cam button opening 331. The lower portion of the casing 14 is so formed as to leave an annular gap between the casing 14 and the middle shaft 33. The lower ("outer") shaft 26 extends around and above the lower end 330, to within the casing 14.

The lower edges of the side plates 5, 5*a* abut against the upper surface of a bulkhead 35 formed on the two halves of the casing 14. The portion of the casing 14 below the bulkhead 35 is hollow and forms an annular space surrounding the lower middle shaft 2. Slidably fit within the annular space and surrounding the lower middle shaft 2 is the lower shaft 26 which extends down to the heavy stabilizing weight 27, which ultimately supports the umbrella 31.

The upper end of the lower shaft 26 abuts against the lower surface of the bulkhead 35 formed within the casing 14. A plurality of openings defined by edges 60 are arranged through the circumferential wall of the lower shaft 26, at a location so as to mate with the cam button 12 and its mating opening 331 through the lower middle shaft 2 when the lower shaft 26 abuts against bulkhead 35. In the embodiment shown in the drawings, there are four mating openings 60 through the upper portion of the lower shaft 26, 90° apart and equally distant from the upper edge 332 of the lower shaft 26.

A thumb button 25 is secured through an opening in the casing 14 arranged to mate with the cam button 12. The radially inwardly facing surface of the thumb button 25 abuts against the radially outwardmost portion of the cam surface 122 and is thus resiliently held in position between the flange 141 formed on the inner surface of the housing 14 and the thumb button washer surface 251.

In this preferred embodiment, the umbrella is demountable such that the middle shaft 33 and the remaining portion of the umbrella thereabove can be readily separated from the lower support shaft 26 utilizing the mechanism of this invention. The lower shaft 26 is rigidly secured to the lower middle shaft 2 when the cam release button is mated with and extends through one of the four openings 60.

Figure 4:
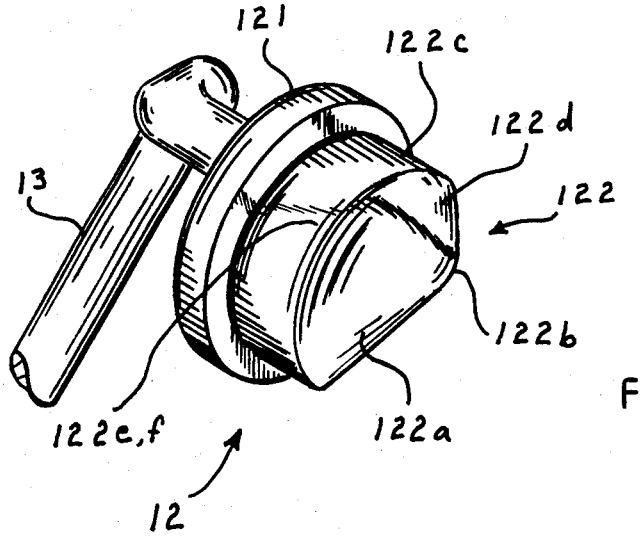
FIG. 4 is an enlarged perspective view of the cam button of this invention.

In the embodiment shown in the drawings, the cam surface, as more clearly shown in FIG. 4, provides a relatively gradually slanted surface, 122*a*, which extends at a slant from a portion at or adjacent to the washer 121 out to the radially outwardmost point 122*b*, and which faces towards the first end 330 of the inner, middle, shaft 33. The portion 122*c* of the side surface of the cam 122, which faces 180° away from the first end 330, extends substantially perpendicularly radially outwardly from the washer 121 up to or almost up to the high point 122*b*. In this embodiment there is a small slanted surface 122*d* between the perpendicular portion 122*c*, and the radial peak 122*b*.

The portions of the cam surface 122 facing in horizontal or sideward directions 122*e,f*, also include an initial portion perpendicular to the washer 121 and a slanted portion between the perpendicular portion and the radial high point 122*b*.

In operation, the umbrella can be connected to the lower shaft by merely placing the lower middle shaft 2 within the central opening of the lower shaft 26 and pressing downwardly. The pressure of the upper end of the lower shaft 26 pressing against the slanted cam surface 122*a* causes the cam button 12 to move radially inwardly against the pressure of the torsion spring 13. As the cam button 12 moves below the level of the circumferential surface of the middle shaft 3, it permits the lower shaft 26 to ride over the button. The middle shaft 33 and lower shaft 26 can be rigidly secured together by mating one of the four openings in the outer lower shaft 26 with the cam button, at which point the cam button snaps outwardly locking the lower shaft 26 to the umbrella and middle shaft 33. An attempt to pull the umbrella outwardly once the cam button is seated through one of the four holes is prevented by the upwardly (offwardly) facing perpendicular surface 122*c* of the cam button, which does not permit the relative movement between the two shaft portions 2, 26. When it is desired to remove the umbrella, the thumb button 25 can be depressed until the perpendicular portion 122*c* of the cam button is moved inward of the circumferential surface of the shaft 33, so that the edge of opening 60 can press against and ride over the slant portion 122*d* of the cam button.

Similarly, when it is desired to rotate the umbrella, such as when the sun moves such that the slant umbrella no longer provides shade on the table, the thumb button 25 is manually depressed until the sideways slant surfaces 122*e,f* are in contact with the inner edge of the index opening 60. The umbrella can then be rotated as the lower shaft 26 rides over the cam button 12 until the cam button 12 mates with the next index opening 60. The cam button pushes outwardly into that opening, locking the umbrella in the new position, 90° away from its first position.

In the most preferred embodiment, the casing 30 also encloses the mechanism for opening or closing the umbrella. The handle 9 is rigidly secured to a spool 6 via the drive shaft 10, which is in turn rotatably secured to the rigid side plates 5, 5*a*. A pawl and ratchet limit movement of the shaft 10. Transmission member 51 directly operates the umbrella upon rotation of the spool 6.

The patentable embodiments of this invention which are claimed are:

1. For a tiltable shade umbrella comprising an umbrella portion; an upper shaft supporting the umbrella portion; a middle shaft pivotally secured to the upper shaft above a horizontal axis; means for locking the upper and middle shafts selectively into a linear configuration and into an angular configuration; the improvement which comprises a lower shaft selectively rotatably, slidably, releasably mounted to the middle shaft, one within the other; a cam button resiliently secured to the innermost shaft of the lower and middle shafts, so as to protrude radially beyond the circumferential surface of the innermost shaft adjacent a first end thereof, and through one of a plurality of openings arranged circumferentially around the outermost shaft adjacent a first outer end thereof; the cam button being shaped to permit slidably interconnecting the middle and lower shafts by inserting the inner first end into the outer first end and sliding the outer shaft over the cam button until the cam button seats through one of the plurality of openings; sleeve means secured to and formed around the innermost of the middle and lower shafts, covering the opening therethrough but spaced radially outwardly therefrom so as to permit the outer shaft to slide thereunder; manual button means, radially movably secured to the sleeve means and in contact with the cam button to move the cam button radially inwardly of the outer shaft to release the outer shaft; and stop means within the casing to limit the movement of the lower shaft over the middle shaft so that the cam button is axially aligned with the plurality of holes in the lower shaft.

2. The umbrella of claim 1 wherein the portion of the cam button facing towards the inner end is leveled to form at least one slanted surface from a level allowing camming engagement of slanted surface below the outer circumferential surface of the inner shaft radially outwardly and axially away from the inner end to a radial peak, the portion of the cam button facing directly away from the inner end extending perpendicularly radially outwardly beyond the outer circumference of the inner shaft.

3. The umbrella of claim 2, wherein the side surfaces of the cam button, facing 90° away from the inner end, extend perpendicularly radially outwardly beyond the circumferential surface of the inner shaft.

4. The umbrella of claim 3 wherein the lower shaft is the outer shaft.

5. The umbrella of claim 4 comprising at least four openings formed adjacent the outer first end of the lower shaft, equally spaced about the circumference thereof.

6. The umbrella of claim 5 wherein the sleeve means comprises a casing secured to the middle shaft, and further comprising manual operating means for opening and closing the umbrella secured within the casing.

* * * * *